US011221026B2

(12) United States Patent
Laufer

(10) Patent No.: US 11,221,026 B2
(45) Date of Patent: Jan. 11, 2022

(54) FAN

(71) Applicant: ebm-papst St. Georgen GmbH & Co. KG, St. Georgen (DE)

(72) Inventor: Wolfgang Laufer, Aichhalden (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 0 days.

(21) Appl. No.: 16/742,985

(22) Filed: Jan. 15, 2020

(65) Prior Publication Data

US 2020/0149536 A1 May 14, 2020

Related U.S. Application Data

(63) Continuation of application No. PCT/EP2018/070283, filed on Jul. 26, 2018.

(30) Foreign Application Priority Data

Aug. 7, 2017 (DE) ..... 10 2017 007 370.8

(51) Int. Cl.
*F04D 29/70* (2006.01)
*F04D 19/00* (2006.01)
(Continued)

(52) U.S. Cl.
CPC ..... *F04D 29/703* (2013.01); *F04D 19/002* (2013.01); *F04D 25/0613* (2013.01);
(Continued)

(58) Field of Classification Search
CPC .... F04D 29/703; F04D 25/0693; F04D 25/08; F04D 25/0613; F04D 29/544;
(Continued)

(56) References Cited

U.S. PATENT DOCUMENTS 2,855,141 A * 10/1958 Van Rijn ..... F04D 25/0613 417/423.14
2,950,859 A * 8/1960 Kirk ..... F04D 29/703 417/363
(Continued)

FOREIGN PATENT DOCUMENTS

CN 201368064 Y 12/2009
DE 3528748 3/1986
(Continued)

OTHER PUBLICATIONS

Chinese Office Action dated Oct. 12, 2020 in corresponding Chinese Application No. 201880031974.2.
(Continued)

*Primary Examiner* — Peter J Bertheaud
(74) *Attorney, Agent, or Firm* — Harness, Dickey & Pierce, P.L.C.

(57) ABSTRACT

A housing (17) of a fan (1) has an inflow-side end surface (2), an outflow-side end surface (16), and a wall ring (15). The wall ring 15 extends in a direction of an axis (12) from one of the end surfaces (2) to the other (16) and adjoins a fan passage. A fan wheel (10) is arranged in the fan passage. A grid (3) is arranged on the inflow-side end surface (2). The grid has a hub (8) positioned centrally in the fan passage. Primary struts (4) extend in the radial direction between the hub (8) and the edge of the fan passage. Secondary struts (6) intersect the primary struts (4).

15 Claims, 2 Drawing Sheets

(51) Int. Cl.

| | |
|---|---|
| ***F04D 25/06*** | (2006.01) |
| ***F04D 29/54*** | (2006.01) |
| ***F04D 29/66*** | (2006.01) |
| ***F04D 29/52*** | (2006.01) |
| ***F04D 25/08*** | (2006.01) |
| ***F04D 29/42*** | (2006.01) |

(52) U.S. Cl.
CPC ..... *F04D 25/0646* (2013.01); *F04D 25/0693* (2013.01); *F04D 25/08* (2013.01); *F04D 29/4226* (2013.01); *F04D 29/526* (2013.01); *F04D 29/541* (2013.01); *F04D 29/544* (2013.01); *F04D 29/667* (2013.01)

(58) Field of Classification Search
CPC .... F04D 19/002; F04D 29/526; F04D 29/541; F04D 29/667; F04D 25/0646; F04D 29/325; F04D 29/4226
See application file for complete search history.

(56) References Cited

U.S. PATENT DOCUMENTS

| | | | | |
|---|---|---|---|---|
| 4,120,615 | A * | 10/1978 | Keem | F04D 29/526 417/360 |
| 5,304,040 | A | 4/1994 | Wang | |
| 6,503,060 | B1 | 1/2003 | Kamada et al. | |
| 6,899,521 | B2 * | 5/2005 | Horng | F04D 29/667 415/119 |
| 6,910,862 | B2 * | 6/2005 | Horng | F04D 29/667 415/211.2 |
| 7,011,504 | B2 * | 3/2006 | Seo | F04D 29/703 415/121.2 |
| 7,018,175 | B2 * | 3/2006 | Horng | F04D 29/541 257/E23.099 |
| 7,334,988 | B2 * | 2/2008 | Horng | F04D 29/667 415/211.2 |
| 7,811,069 | B2 * | 10/2010 | Fleig | F04D 25/0613 417/423.14 |
| 2005/0118022 | A1 | 6/2005 | Fu | |
| 2014/0141708 | A1 | 5/2014 | Baker | |
| 2017/0114803 | A1 | 4/2017 | Miwa | |

FOREIGN PATENT DOCUMENTS

| | | |
|---|---|---|
| DE | 9206992 | 8/1992 |
| JP | H 06-280566 | 10/1994 |
| JP | H 06-280567 | 10/1994 |

OTHER PUBLICATIONS

International Search Report And Written Opinion (in German) dated Oct. 10, 2018.
European Office Action dated May 28, 2021 in corresponding European Application No. 18746183.5.

* cited by examiner

FAN

CROSS-REFERENCE TO RELATED APPLICATIONS

This application is a continuation of International Application No. PCT/EP2018/070283, filed Jul. 26, 2018, which claims priority to German Application No. 10 2017 007 370.8, filed Aug. 7, 2017. The disclosures of the above applications are incorporating herein by reference.

FIELD

The present disclosure relates to a fan, particularly for installation in a device for cooling. Essential requirements for such a fan are a compact design, energy efficiency, and low-noise operation.

BACKGROUND

Fans often have a square-shaped housing. A fan passage extends between an inflow-side and an outflow-side end surface. A motor and a fan wheel are located in the fan passage. A fan of this type is shown in DE 35 28 748 C2. With this fan, the motor and the fan wheel are connected to a wall ring adjoining the fan passage by a grid. The grid is arranged on the outflow-side end surface of the fan. The grid includes struts extending in the radial direction.

Such a grid can effect a static pressure increase. This improves the static efficiency of the fan and the strength of the airflow, by a swirl reduction, that causes blown-through air.

The same publication, DE 35 28 748 C2, also considers the possibility of attaching a grid to the inflow-side of the fan. However, practical use has shown that such an arrangement causes strong operating noise. This may be a reason why the inflow-side grid of conventional fans is designed as a separate component. Thus, its application can be limited to cases where the flow noise does not cause a disturbance.

An important cause of the operating noise of fans are pressure fluctuations on solid surfaces of the fan. This noise is usually linked to fluctuations in the speed where air flows on and over the surfaces. A point at which high local pressures occur in operation is the front edge of a blade of the fan wheel. The front edge alternatingly skims passed struts of a grid and intermediate spaces between the struts in the course of the rotation of the fan wheel. This leads to strong fluctuations in the flow rate on the blade and accordingly to strong noise development.

The environment where a fan is installed may also contribute to the development of flow noise. When a fan is installed in a device, asymmetries in the flow channels of the device may lead to non-homogenous inflow to the blades of the fan. Thus, this leads to noise-intensive speed and pressure fluctuations. Fittings, such as sheet-metal edges and rough deflections with associated flow separation on components in the inflow to the fan, cause non-homogenous speed distributions of the inflow field. This interacts with the blades.

SUMMARY

It is an object of the disclosure to obtain a low-noise and simultaneously an efficient fan.

The object is achieved by a fan with a housing comprising an inflow-side end surface, an outflow-side end surface, and a wall ring. The wall ring extends in the direction of an axis from one of the end surfaces to the other. It adjoins a fan passage, a fan wheel, is arranged in the fan passage.

A grid is arranged on the inflow-side end surface. The grid has a hub positioned centrally in the fan passage. Primary struts extend in the radial direction between the hub and the edge of the fan passage. The grid further has secondary struts that intersect the primary struts.

The intermediate spaces conventionally extend in the radial direction. They apparently offer sufficient space between the struts. Thus, turbulence is generated in the struts due to the blade edges skimming passed. The turbulence is suctioned into the fan passage. It strikes the next blade edge skimming passed with strongly fluctuating speeds. Thus, turbulence with the fan according to the disclosure can be suppressed or at least greatly damped by the secondary struts. Thus, the operating noise of such a fan is reduced in comparison to a fan used under the same conditions without secondary struts.

The primary struts can also support the fan wheel and optionally its motor via the hub. Struts that conventionally serve this purpose can be omitted on the outflow-side end surface. This enables a compact design of the fan. The secondary struts may form at least one ring circulating about the axis of the fan. Preferably, they are concentric to the axis.

In order to effectively suppress the aforementioned turbulence, the dimensions of openings, that are limited by the primary and secondary struts in the inflow-side end surface, should preferably be smaller in the radial direction than in the circumferential direction.

In order to effectively damp turbulence, the primary and secondary struts should intersect each other, preferably at a right angle. The axis is vertical on the surface of a primary strut.

In order for air that arises from directions deviating from the axis, of the inflow-side end surface of the fan, to be introduced into the fan passage with low pressure decrease, the secondary struts may be formed as cone-surface sections. They include a small base surface facing the fan wheel.

In order to minimize the intake-side pressure drop, the opening angle of the cone-surface sections increases with the distance of the secondary struts from the axis.

The primary struts may have a straight elongated cross-section in the direction of the axis. This simplifies the single-part molding of the grid. This is particularly true when the secondary struts are oriented at an angle to the axis. This is the case with the previously mentioned cone-surface sections.

In cases where the inflow situation in the device requires this, it may be advantageous to form the secondary struts with a curved cross-section. The cone-surface sections have an opening angle that changes over the axial extension.

A motor driving the fan wheel can be mounted on the hub.

At least one of the grid struts, supporting the hub, may also be provided in order to guide a supply cable of the motor to the struts.

Alternatively, in order to minimize the cross-section of the grid struts, a strut guiding the supply cable may be formed separately from the grid. It may be placed upstream of the grid on the inflow side.

In order to simplify production of the fan, the grid may be formed as one piece with the wall ring of the housing.

In order to minimize periodic pressure and speed fluctuations in the air flow in the audible frequency domain, due to the blade wheels passing by the primary struts, the number of primary struts of the grid and the number of blades of the blade wheel should be coprime.

In order to prevent abrupt short-term interactions between the blades and the primary struts of the grid, the inflow-side edges of the blades of the fan wheel should intersect the primary struts.

The extension of the inflow-side edges in the circumferential direction corresponds at least to the distance between the primary struts. Each inflow-side edge intersects at least one primary strut in each phase of rotation. Thus, the fan wheel is continually exposed to the forces occurring at the point of intersection between the edge and the strut.

The grid can function as an electromagnetic shield of the motor when at least a few of the primary or secondary struts are electrically conductive. With a grid made of plastic, the conductivity can be due to a conductive aggregate in the plastic or due to a conductive surface coating.

Other advantageous further developments of the disclosure are characterized in the dependent claims or are explained in more detail below with reference to the figures and together with a preferred embodiment of the disclosure.

DRAWINGS

Further features and advantages of the disclosure result from the following description of exemplary embodiments with reference to the appended drawings. The following is shown:

DETAILED DESCRIPTION

Figure 1:
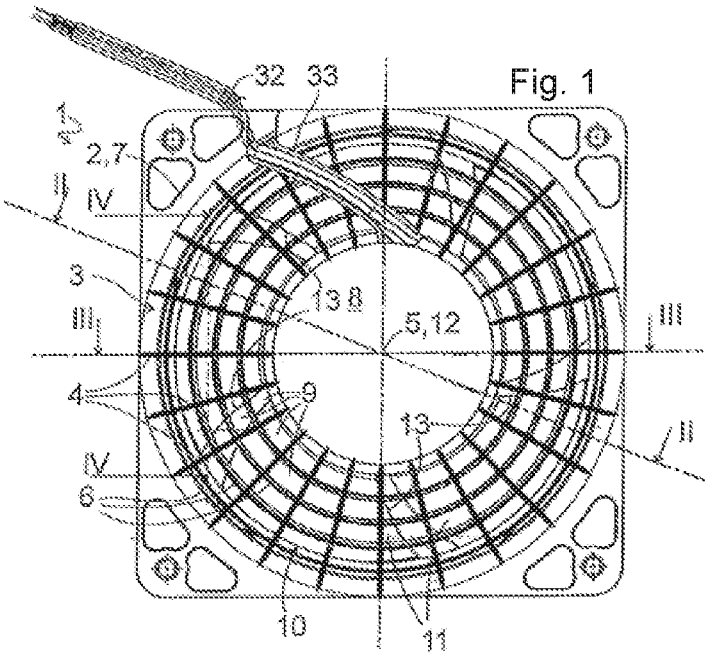
FIG. 1 is a top view in the axial direction of a fan according to the disclosure.

FIG. 1 illustrates a top plan view of an inflow-side end surface 2 of a fan 1. The end surface 2 is square-shaped. A circular central region of the end surface 2 is filled by a grid 3. The grid 3 includes numerous tapered primary struts 4 in a straight line on a common central point 5. Secondary struts 6 extend concentrically about the central point 5. The primary struts 4 are connected, at their ends, as a single piece to a frame 7 enclosing the grid 3 and/or to a circular hub 8 occupying the center of the grid 3.

The primary and secondary struts 4, 6 intersect each other at a right angle. Thus, they adjoin a plurality of openings 9.

Figure 2:
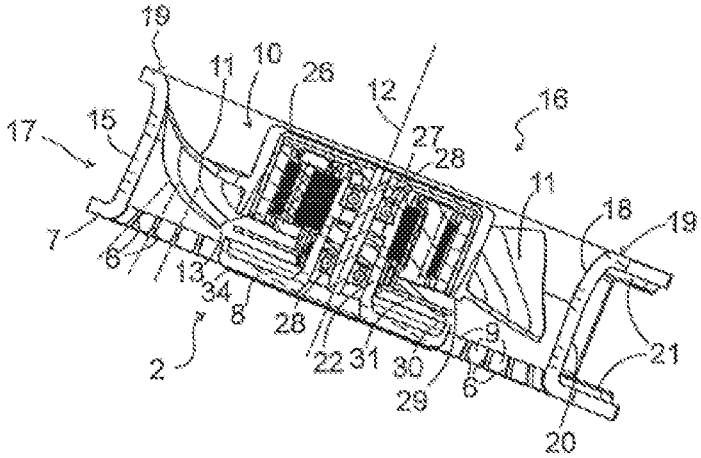
FIG. 2 is an axial section view through the fan along line II-II of FIG. 1.
Figure 3:
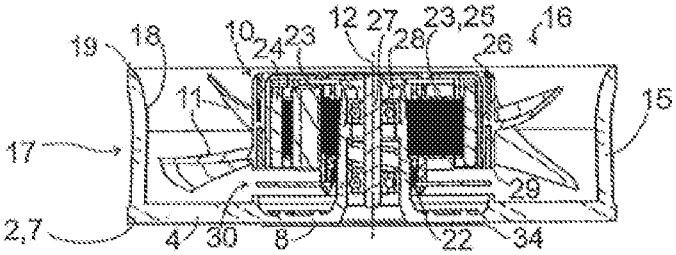
FIG. 3 is an axial section view through the fan along line III-III of FIG. 1.

The edges of blades 11 of a fan wheel 10 lying behind the end surface 2 emerge through the openings 9 (see FIGS. 2, 3). An axis of rotation 12 of the fan wheel extends through the central point 5 vertical to the paper plane of FIG. 1.

The number of primary struts 4 is significantly greater than the number of blades 11. In the example shown here, there are 24 primary struts 4 to five blades 11. Thus, a slight inclination of the inflow-side edges 13 of the blades 11, the edges facing the grid 3, is sufficient such that any inflow-side edge 13 in any setting that the fan wheel 10 assumes in the course of a rotation about the axis 12 intersects at least one of the primary struts 4. Aerodynamic forces act upon the fan wheel 10 as a result of pressure fluctuations occurring in the area of intersection of the edges 13 with the struts 4. Thus, they fluctuate only slightly over the course of a rotation of the fan wheel. Accordingly, they also generate very little noise.

Sectional plane II-II, in FIG. 2, extends along the axis 12. It intersects the openings 9 concentrically between two primary struts 4. Thus, the secondary struts 6 can be seen in the section. The secondary struts 6 each form a section of a cone surface. The majority of struts 6 have a cone surface that converges in the flow direction of the air. The dotted lines indicate the profile of the cone surface in the axial extension of the struts 6. The dotted lines intersect the axis 12 downstream of the fan housing 14. The opening angle of the cone surfaces becomes greater as the distance between the struts 6 and the axis 12 increases. Thus, the diversified arrangement of the struts 6 facilitates the intake of air from directions deviating from the axis 12.

Figure 4:
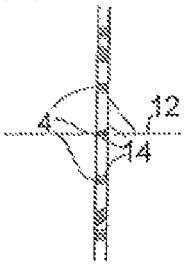
FIG. 4 is a section view through the fan along line IV-IV of FIG. 1, offset to the axis.

FIG. 4 shows a section through the grid 3 along a line, labeled Iv-Iv in FIG. 1. It extends eccentrically parallel to the axis 12. As shown in this figure, the primary struts 4 have an axially elongated cross-section with flanks 14. The flank 14 extend in a direction parallel to the axis 12. This prevents undercuts, which are inaccessible from both directions, from emerging at the intersections of the primary and secondary struts 4, 6 in the direction of the axis 12. Thus, the grid 3 can be injection-molded using only two molding tool parts. They move in opposition to one another in the direction of the axis 12.

As particularly can be seen in FIGS. 2 and 3, a wall ring 15, extending concentrically to the axis, starts from the inner edge of the frame 7. A second frame, that extends about the end of the wall ring 15, faces away from the inflow-side end surface 2. The second frame forms an outflow-side end surface 16 of the fan 1. The end surfaces 2, 16 and the wall ring 15 are linked together as a single part and form a fan housing 17.

In order to form this fan housing 17, four molding tool parts are sufficient. Namely the two previously mentioned that took part in the molding of the grid 3. One of which also engages the wall ring 15 in order to form the inner side 18 and an outer side 19 of the outflow-side end surface 16. Further, two tool parts, that move radially with respect to the axis 12, each form a half of an outer side 20 of the wall ring 15 as well as inner sides 21, facing one another of the two end surfaces 2, 16.

The plastic used to form the fan housing 17 can be made electrically conductive. This occurs by the addition of graphite or metal powder. The grid 3 can serve as an electromagnetic shield. This helps to prevent a fault in sensitive electronics due to electromagnetic emission of the motor 25.

A sleeve 22, concentric to the axis 12, is formed on the hub 8. A stator 23, of an electric motor 25, is mounted about the sleeve 22. A corresponding rotor 24 is accommodated in a cup 26. The cup 26 is covered by the sleeve 22 and opened towards the hub 8. A shaft 27, which is rotatably mounted in the interior of the sleeve 22, via roller bearings 28. The shaft 27 starts from the base of the cup 26. The blades 11 stick out from the circumference of the cup 26.

An air gap 30 extends between the hub 8 and an edge 29 of the cup 26 facing the hub. A circuit board 31, with control electronics for the electric motor 25, is arranged in this air gap 30. The circuit board 31 is cooled by the air flow driven by the fan 1.

A supply cable 32 extends between the motor 25 and the frame 7. The supply cable may be attached to one of the radially oriented primary struts 4. Such a primary strut, however, would unavoidably be wider than the remaining primary struts due to the supply cable.

An inflow-side edge 13 only intersects the strut sometimes in the course of a rotation of the fan wheel 10. Thus, flow noise resulting from the edges 13 passing by the strut would pulse. Accordingly, it would be significantly perceptible as operating noise even with an objectively low loudness level. In order to minimize such noise, the grid 3 is arranged in the axial direction between the strut guiding the supply cable 32 and the fan wheel. Thus, the flow conditions and the noise development on the fan wheel 10 are determined essentially by the grid 3. To this end, the strut guiding the supply cable 32 could be upstream of the grid 3 in the axial direction.

The placement of the supply cable 32 is in a strut 33, as shown in FIG. 1. The strut 33 adjoins the inflow-side end surface 2. The axial extension of the strut 33 is less than struts 4, 6 and is more compact. Thus, the latter protrudes toward the fan wheel 10, via strut 33, and damp influences of the strut 33 on the flow conditions at the fan wheel 10.

A design of the strut 33 as a channel open to the end surface 2 has the advantage that the dimensions can be kept small in the axial direction. Thus, there is a lot of space between the strut 33 and the fan wheel 10 for struts 4, 6 of the grid 3. The struts damping the influence of strut 33 and protruding to the fan wheel 10 via strut 33.

The channel shape of the strut 33 further facilitates the attachment of the supply cable 32 to the fan. After assembly of the motor 25, the supply cable 32 is inserted into the channel of the strut 33. At an end with the motor 25 connections exposed on the inflow-side surface of the hub 8, the connections establish contact with the supply cable 32. Subsequently, the connections can be hidden by the application of a label 34 (see FIGS. 2, 3) onto the hub 8.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fan having a housing comprising:

an inflow-side end surface enabling air to enter into the housing;

an outflow-side end surface enabling air to exit the housing;

a wall ring extends in the direction of an axis from one of the end surfaces to the other and adjoins a fan passage, a fan wheel is arranged in the fan passage;

a grid is arranged on the inflow-side end surface, the grid has a hub positioned centrally in the fan passage;

primary struts extend in the radial direction between the hub and the edge of the fan passage;

the grid further comprises secondary struts, the secondary struts intersect the primary struts, the secondary struts are formed as cone-surface sections, wherein a majority of the cone surface sections are at an angle with respect to the axis, a line extending through each of the secondary strut cone surface sections intersect the axis on an outflow-side, an opening angle of the cone-surface sections increases with the distance of the secondary struts from the axis and the secondary struts include a small base surface facing the fan wheel.

2. The fan according to claim 1, wherein the secondary struts form at least one ring circulating about the axis.

3. The fan according to claim 1, wherein the primary and secondary struts adjoin openings in the inflow-side end surface, the dimensions of the openings being smaller in the radial direction than in the circumferential direction.

4. The fan according to claim 1, wherein the primary and secondary struts intersect one another at a right angle.

5. The fan according to claim 1, wherein an opening angle of the cone-surface sections increases with the distance of the secondary struts from the axis.

6. The fan according to claim 1, wherein the primary struts have a straight elongated cross-section in the direction of the axis.

7. The fan according to claim 1, wherein a motor, driving the fan wheel, is mounted on the hub.

8. The fan according to claim 7, wherein a supply cable of the motor is guided on a strut of the grid.

9. The fan according to claim 8, wherein the strut accommodating the supply cable is formed as a channel open to the inflow-side end surface.

10. The fan according to claim 7, wherein a strut guiding the supply cable is upstream of the grid on the inflow side end surface.

11. The fan according to claim 1, wherein the grid is formed as a single piece with the wall ring.

12. The fan according to claim 1, wherein a number of primary struts of the grid and a number of blades of the fan wheel are coprime.

13. The fan according to claim 1, wherein fan wheel blade edges on an inflow-side facing the grid if extended would intersect the primary struts.

14. The fan according to claim 13, wherein an extension would correspond to a distance between the fan wheel blade edges, on the inflow-side facing the grid, and the primary struts in the circumferential direction.

15. The fan according to claim 1, wherein at least some of the primary or secondary struts are electrically conductive.

* * * * *